United States Patent [19]

Bunch, Jr.

[11] 4,447,219

[45] May 8, 1984

[54] DELIVERY MECHANISM FOR PAPER SHEET PROCESSING APPARATUS

[76] Inventor: Earnest B. Bunch, Jr., 9619 N. 21st Dr., Phoenix, Ariz. 85021

[21] Appl. No.: 474,186

[22] Filed: Mar. 10, 1983

Related U.S. Application Data

[63] Continuation-in-part of Ser. No. 412,392, Aug. 30, 1982.

[51] Int. Cl.[3] ..... B65H 45/20

[52] U.S. Cl. ..... 493/410; 493/413

[58] Field of Search ..... 493/409–415

[56] References Cited

U.S. PATENT DOCUMENTS

| | | | |
|---|---|---|---|
| 3,352,553 | 11/1967 | Preston | 493/413 |
| 3,499,643 | 3/1970 | Biggar | 493/415 |
| 4,026,452 | 5/1977 | Megen | 493/410 X |

FOREIGN PATENT DOCUMENTS

| | | | |
|---|---|---|---|
| 2506901 | 8/1975 | Fed. Rep. of Germany | 493/413 |

*Primary Examiner*—A. J. Heinz

*Attorney, Agent, or Firm*—Drummond & Nissle

[57] ABSTRACT

A machine for folding continuous form stationery along transverse lines of weakening formed in the stationery. The machine includes a primary endless belt system for alternately distributing lines of weakening in the stationery in opposite lateral directions of travel. Stationery distributed by the primary endless belt system is received between a pair of opposed endless belt units. The pair of endless belt units are operatively associated and cooperate with the primary endless belt system to fold stationery distributed by the primary belt system and form a zig-zag stack of stationery between the pair of opposed belt units. The pair of opposed belt units gradually carries distributed stationery away from the primary belt system.

2 Claims, 12 Drawing Figures

FIG. 1
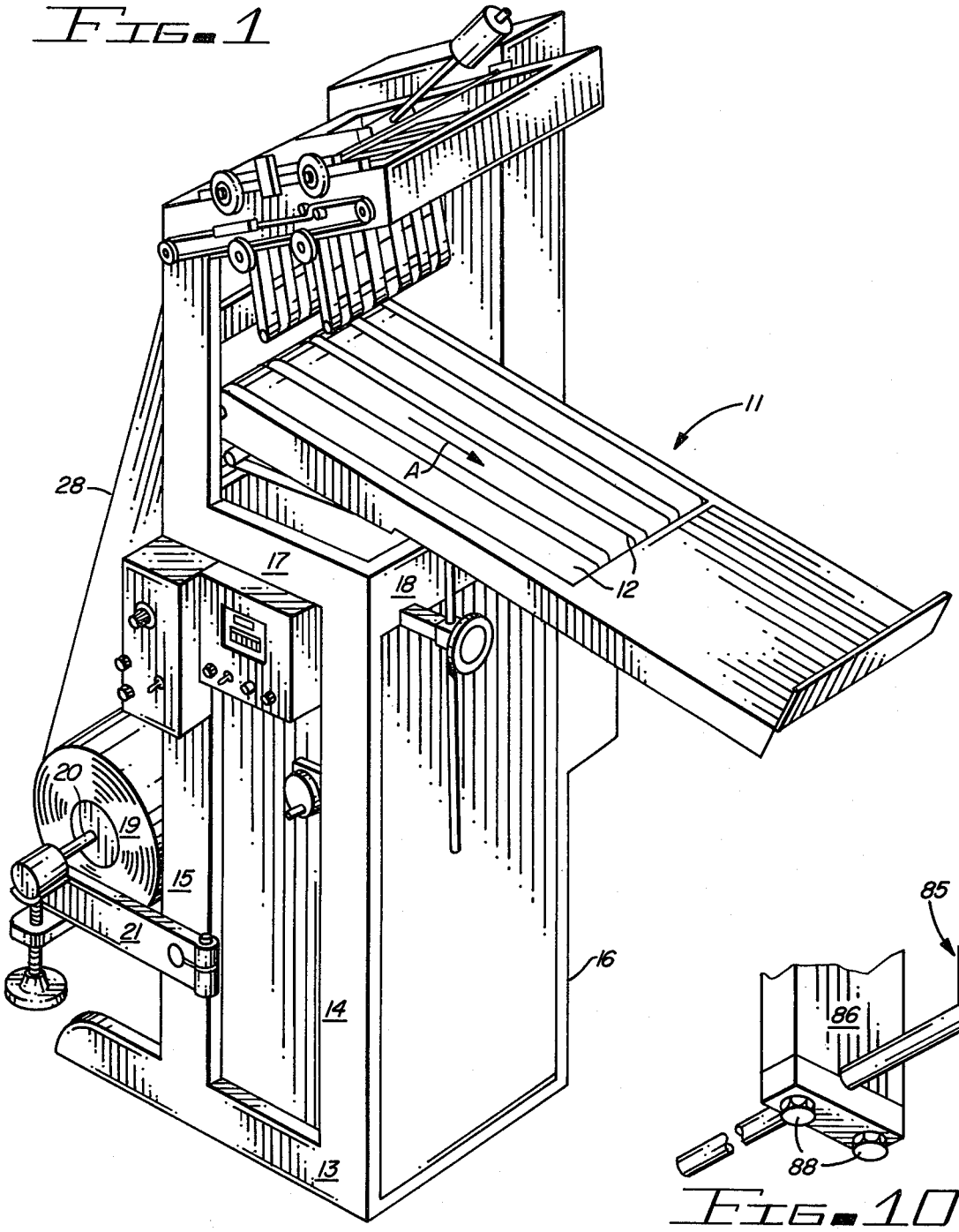
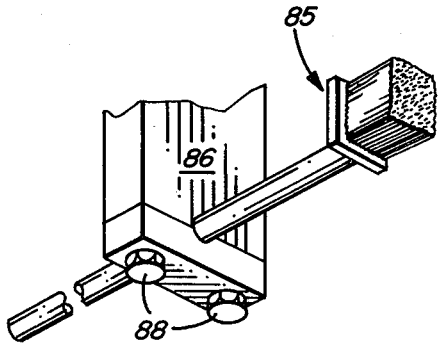
FIG. 10
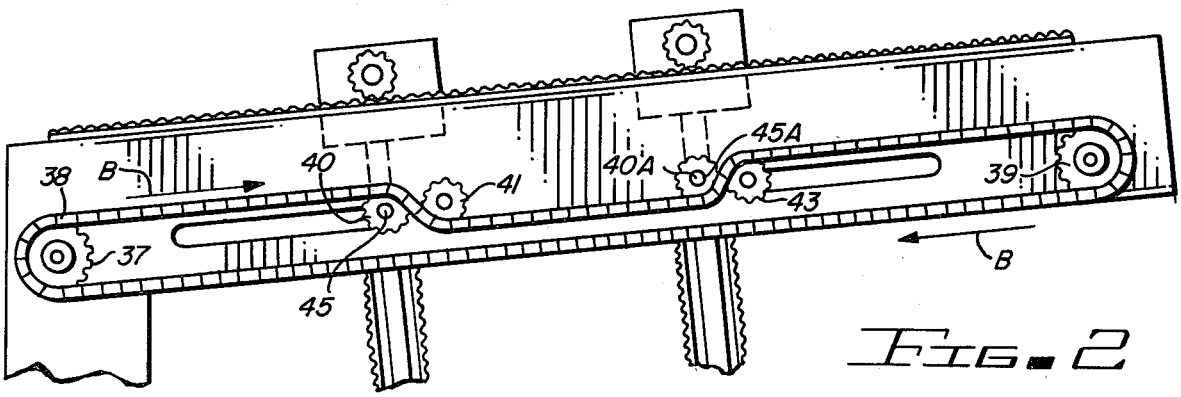
FIG. 2

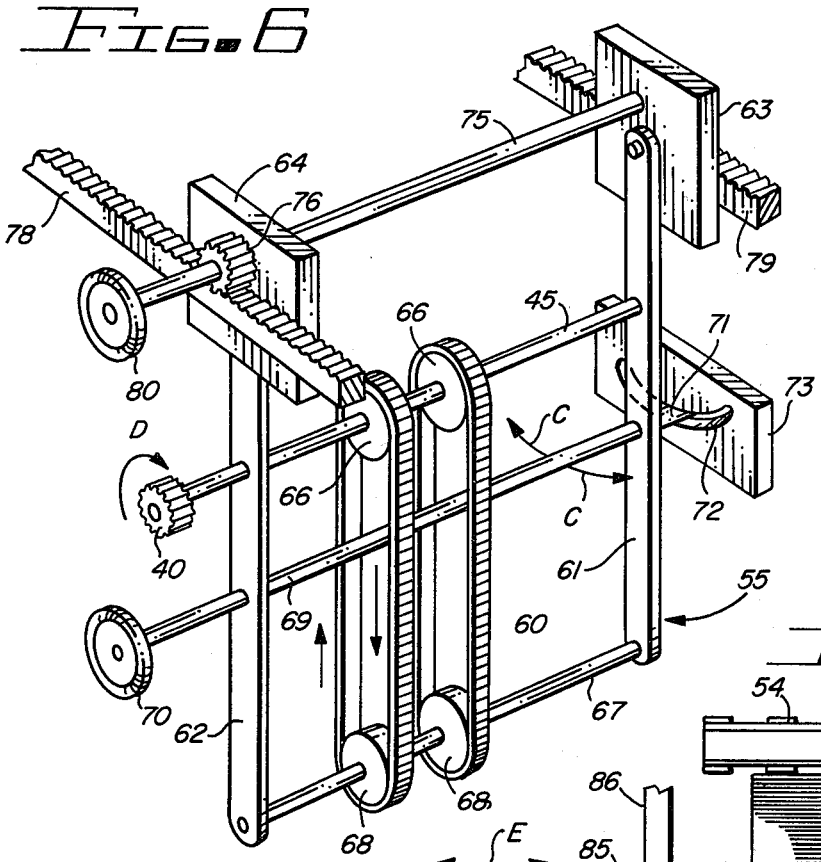
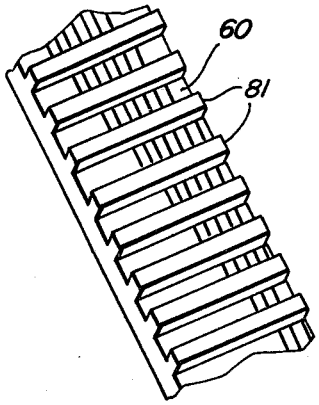
FIG. 9A
FIG. 7
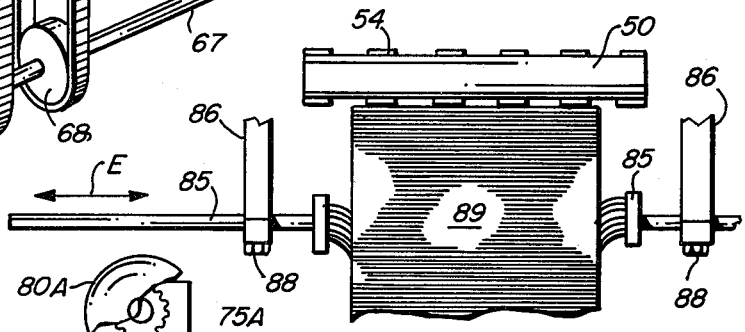
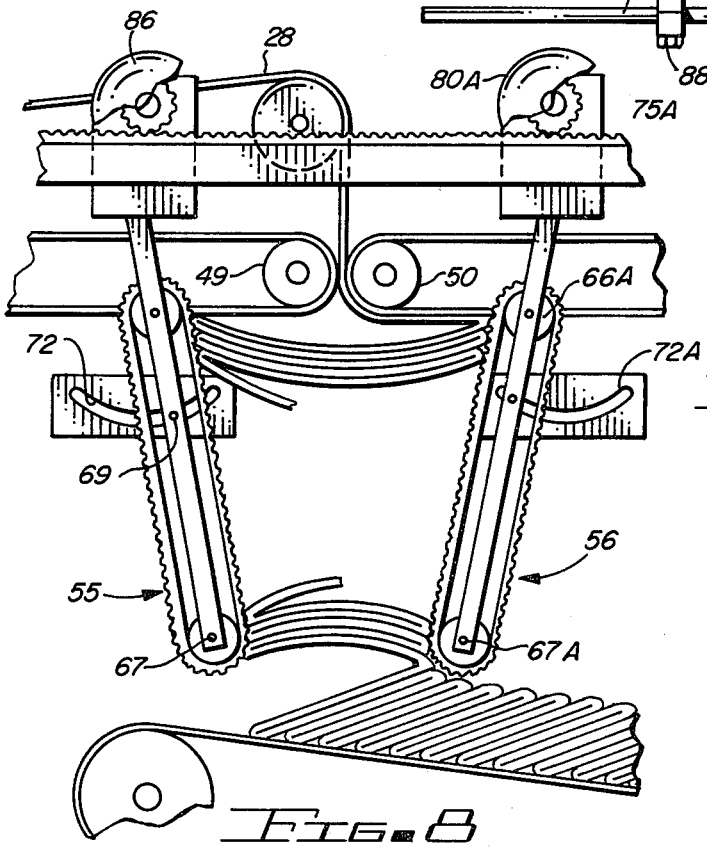
FIG. 8
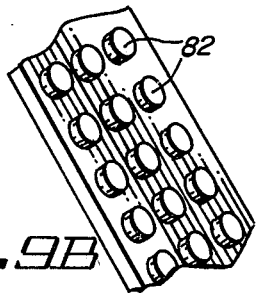
FIG. 9B
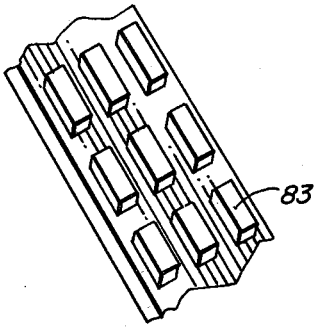
FIG. 9C

DELIVERY MECHANISM FOR PAPER SHEET PROCESSING APPARATUS

This comprises a continuation-in-part of my copending application Ser. No. 412,392, filed Aug. 30, 1982 for "DELIVERY MECHANISM FOR PAPER SHEET PROCESSING APPARATUS".

This invention relates to paper manufacturing apparatus.

More particularly, the invention relates to improved apparatus for transporting continuous form stationery produced by folding a strip of paper along transverse lines of weakening formed therealong, the improved paper transport apparatus facilitating the delivery of folded continuous form stationery to a packing station.

In a further respect, the invention concerns an improved delivery mechanism for a stationery folding machine of the type having feed rollers which direct a continuous strip of paper between first and second endless belt units which distribute successive lines of weakening in the paper in substantially opposite directions, each endless belt unit including a plurality of endless belts and having a roller spaced adjacent to and parallelably disposed with respect to a roller in the companion endless belt unit, the continuous strip of paper dispensed by the feed rollers traveling between the adjacent rollers and being distributed by endless belts carried thereon.

In another respect, the invention concerns an improved paper folding machine which can rapidly fold lightweight chart paper of the type utilized on electrocardiogram machines and other scientific recording equipment.

The general type of paper folding machine described in U.S. Pat. No. 3,352,553 to Preston has achieved wide commercial acceptance since it was introduced on the market. While the apparatus described in the Preston patent has undergone substantial improvements, some of which are described in the U.S. Pat. No. 3,711,085 to Bunch, Jr., the basic operational combination still consists of a feed roller for directing a strip of paper between a pair of endless belt units which distribute the paper in a zig-zag fashion, of a pair of tamping mechanisms for periodically compressing creased paper distributed by the endless belt units to facilitate the folding and positioning thereof, and of a pair of paper stop assemblies for stopping the lateral travel of creased edges of paper distributed by the endless belt units. Each endless belt unit includes a roller adjacent and parallelably disposed to a roller in the companion belt unit. Endless belts moving over this pair of adjacent rollers cause lines of weakening in paper fed between the adjacent rollers to be alternately distributed in generally opposite directions. A conveyor surface receives the folded paper and transports the paper to a packaging and storage station.

While the "belt folders" described in the U.S. Pat. Nos. 3,352,553 to Preston and 3,711,085 to Bunch, Jr. can effectively fold a wide variety of conventional business forms, these machines cannot fold lightweight chart paper of the type commonly utilized to graphically record data in EKG machines and other scientific apparatus. Consequently, blank chart paper for EKG and other recording apparatus is currently usually wound on a spindle to form a paper roll. In use, a blank roll of chart paper is rotatably mounted on the frame of a recording machine and paper is drawn from the roll through the machine. Floating needles provided with small ink markers inscribe linear data on the chart paper as it passes through the machine. Inscribed chart paper produced by the machine is taken up on a storage spindle. If, instead of being wound on a spindle, chart paper could be successfully folded in zig-zag fashion in individual stacks, the paper could be fed from a folded stack through a recording machine. Inscribed chart paper from the machine would then travel directly into a storage box. The paper would refold in zig-zag fashion as it passed into the storage box. Thus, the ability to pre-fold chart paper in zig-zag fashion would facilitate storage of the paper and would eliminate having to produce spindles to carry and store chart paper. Another disadvantage of winding paper around spindles is that unrolling chart paper from a spindle to view a particular section of inscribed paper can be time consuming. If the section of paper to be viewed is near the spindle carrying the paper, the entire roll of paper must be unrolled. In contrast, when chart paper is folded in zig-zag fashion in individual stacks, each stack of paper can be rapidly thumbed through to locate the desired section of paper.

Accordingly, it would be highly desirable to provide an improved continuous form paper folding machine which could rapidly fold lightweight chart paper of the type commonly found on electrocardiogram machines and other scientific recording apparatus.

Therefore, it is the principal object of the invention to provide an improved paper folding machine.

Another object of the instant invention is to provide an improved paper folding machine of the type having feed rollers which direct a continuous strip of paper between first and second endless belt units which distribute successive lines of weakening in the paper in substantially opposite directions, each endless belt unit including a plurality of endless belts and having a roller adjacent and parallelably disposed with respect to a roller in the companion endless belt unit, the continuous strip of paper dispensed by the feed rollers traveling between the adjacent rollers and being distributed by endless belts carried thereon.

A further object of the instant invention is to provide an improved continuous form paper folding machine which can rapidly fold lightweight chart paper.

These and other, further and more specific objects and advantages of the invention will be apparent to those skilled in the art from the following detailed description thereof, taken in conjunction with the drawings, in which:

FIG. 1 is a perspective view of a continuous form paper folding machine constructed in accordance with the principles of the invention;

FIG. 2 is an enlarged side view of the paper folding machine of FIG. 1 further illustrating a portion of the gear train thereof;

FIG. 6 is a perspective schematic view of one of the vertically disposed endless belt units of the paper folding machine of FIG. 1 further illustrating the mode of operation thereof;

FIG. 7 is a schematic view of a stack of folded paper in the paper folding machine of FIG. 1 illustrating the positioning of retarding brushes with respect to the stack of folded paper;

FIG. 8 is a side view of the folding mechanisms of the paper folding machine of FIG. 1 illustrating how the vertically disposed belt units may be inwardly sloped toward one another to retard the rate of descent of paper distributed by the horizontally disposed belt units;

FIGS. 9A–9C are partial perspective views of alternate embodiments of the vertically disposed endless belts; and FIG. 10 is a perspective view of the retarding brush of FIG. 7.

Briefly, in accordance with my invention, I provide improved apparatus for producing continuous form stationery by folding a strip of paper along transverse lines of weakening formed therein. The apparatus includes a frame; generally horizontally disposed endless belt means mounted on the frame for alternately distributing the successive lines of weakening in the paper in substantially opposite directions, the belt means including a pair of spaced adjacent parallelably disposed rollers; feed means carried on the frame for directing the continuous strip of paper between the adjacent roller pair; and a support surface for receiving paper distributed by the endless belt means. The apparatus also includes means for enabling the apparatus to fold lightweight paper, said means including first endless belt means including at least one generally vertically disposed endless belt having an outer peripheral surface provided with generally horizontally disposed upstanding feet means spaced therealong; and second endless belt means spaced apart from and generally opposed to said first endless belt means, said second endless belt means including at least one generally vertically disposed endless belt means including at least one generally vertically disposed endless belt having an outer peripheral surface provided with generally horizontally disposed upstanding spaced feet means spaced therealong. The first and second endless belt means are positioned on the frame to receive lines of weakening distributed by and cooperate with the horizontal endless belt means to fold the paper along the lines of weakening to produce a zig-zag stack of paper having a plurality of creased edges, the upstanding horizontally disposed feet means formed on the first and second endless belt means generally preventing the creased edges of the paper from downwardly sliding between the first and second endless belt means. The vertically disposed endless belts of the first and second endless belt means move such that paper distributed by the horizontally disposed endless belt means is gradually carried downwardly away from the parallelably disposed rollers by the vertically disposed belts.

Figure 4:
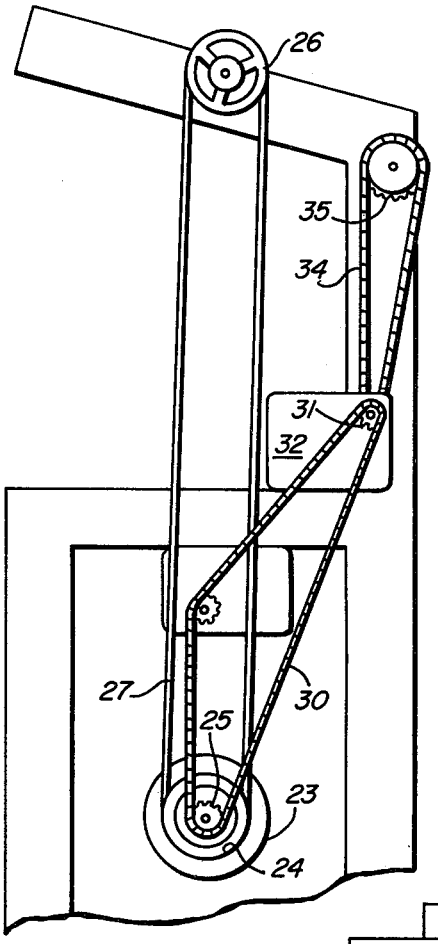
FIG. 4 is an elevation view of the back side of the paper folding machine of FIG. 1 further illustrating the gear train thereof.
Figure 5:
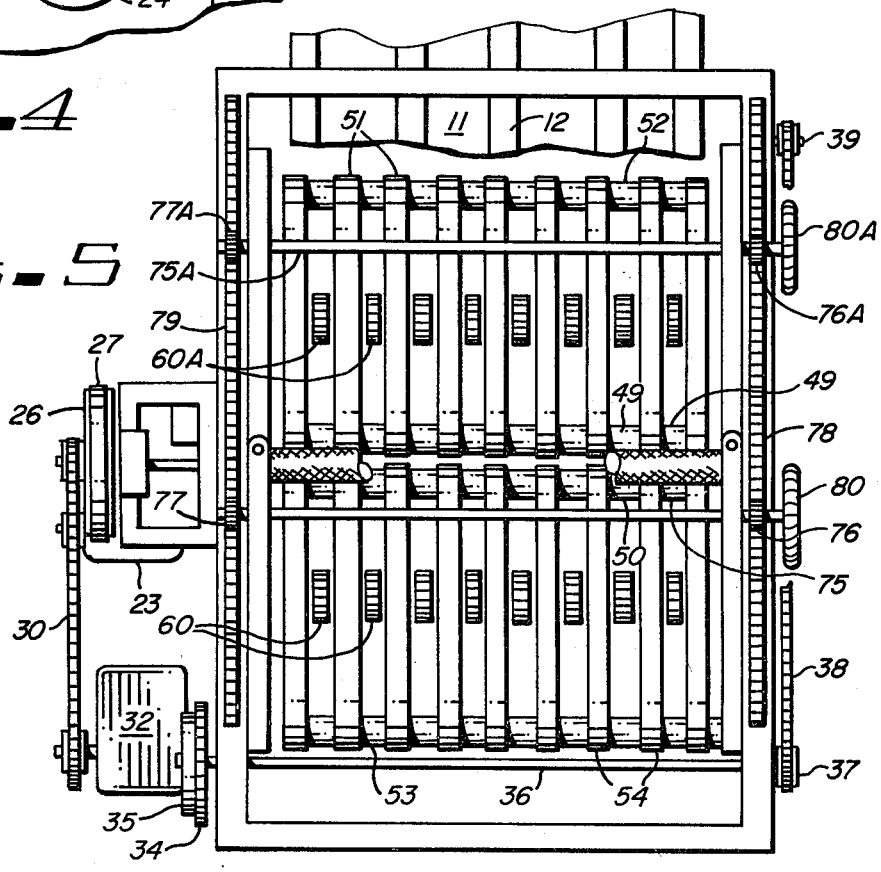
FIG. 5 is a top view of the paper folding machine of FIG. 1 illustrating the relative positions of the horizontally and vertically disposed endless belt units thereof.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a paper folding machine constructed in accordance with the principles of the invention and having a conveyor table 11 with moving endless bands 12 which receive and transport folded paper in the direction of arrow A. Conveyor table 11 and the remaining folding mechanisms of the machine are supported by a frame which includes base 13, vertical support members 14, 15, 16 and horizontal support members 17, 18. Paper roll 19 is rotatably carried on axle 20 supported at either end by an arm 21 attached to the frame of the machine. As shown in FIG. 4, motive power for the drive train of the machine is provided by motor which turns pulley wheel 24 and sprocket 25. As pulley wheel 24 turns, it causes belt 27 to rotate pulley wheel 26. As will be seen, pulley wheel 26 provides the motive power for the horizontally disposed endless belt units which alternately distribute transverse lines of weakening in paper 28 from roll 19 in substantially opposite directions. Sprocket 25 drives chain 30 and sprocket 31. Motive power from sprocket 31 is transmitted through gear box 32 to chain 34 which turns sprocket 35. Sprocket 35 is, as shown in FIG. 5, fixedly attached to and rotates shaft 36 which in turn rotates sprocket 37 and moves chain 38. FIG. 2 illustrates how the movement of chain 38 about sprockets 37 causes sprockets 39, 40, 40A, 41, 43 to rotate. Sprockets 40, 40A are respectively fixedly attached to rotary shafts 45, 45A. The movement of chain 38 around the various sprockets in FIG. 2 is indicated by arrows B. Chain 38 causes sprocket 40 and shaft 45 to rotate in a clockwise direction and sprocket 40A and shaft 40A to rotate in a counterclockwise direction.

Figure 3:
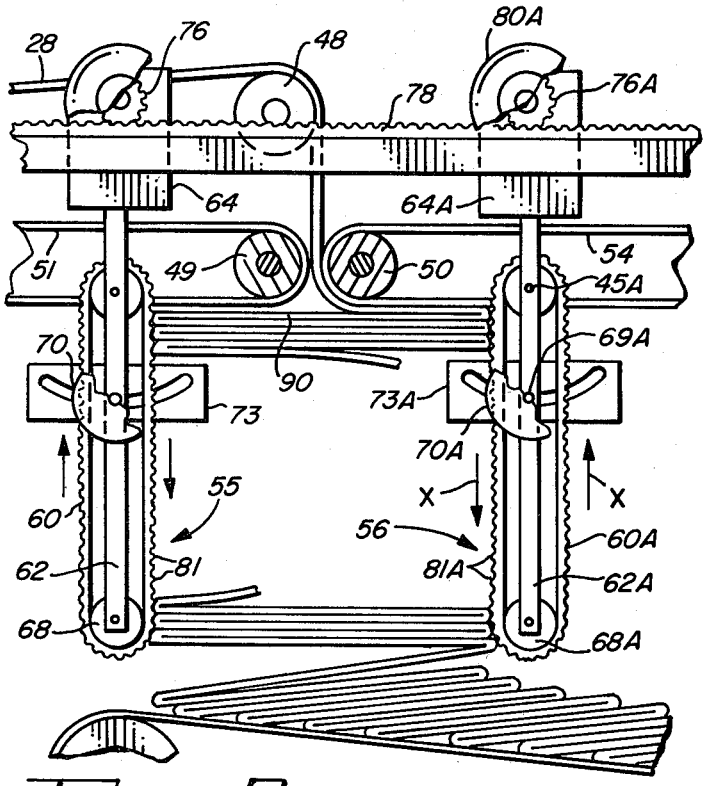
FIG. 3 is an enlarged elevation view of the folding mechanisms of the paper folding machine in FIG. 1 illustrating the mode of operation thereof.

In FIG. 3, paper 28 is pulled from roll 19 by feed roller 48 and is directed between distribution rollers 49, 50. Roller 49 rotates in a clockwise direction. Roller 50 rotates in a counterclockwise direction. The motive power to drive rollers 49, 50 is transmitted from pulley wheel 26 through appropriate gearing (not shown for the sake of clarity) to the axles fixedly carrying rollers 49, 50. Roller 49 is a component of a first horizontally disposed continuous belt unit which also includes continuous belts 51 and roller 52 rotatably carried in the machine frame. Roller 50 is a component of a second horizontally disposed continuous belt unit which also includes continuous belts 54 and roller 53 rotatably mounted in the machine frame. The first and second horizontally disposed continuous belt units generally operate in the same manner as the horizontally disposed continuous belt units shown in U.S. Pat. Nos. 3,711,085 to Bunch and 3,352,553 to Preston.

Transverse lines of weakening which are alternately distributed in substantially opposite directions by belts 51, 54 are received by opposed generally vertically disposed endless belt units 55, 56. Endless belt unit 55 is schematically depicted in FIG. 6 and includes endless belts 60 and generally parallel vertically disposed rods 61, 62 respectively pivotally attached at their upper ends to rectangular support members 63, 64. Shaft 45 is rotatably carried by rods 61, 62. Pulley wheels 66 are fixedly attached to rotary shaft 45. Shaft 67 is permanently, fixedly secured to vertical rods 61, 62 and pulley wheels 68 are rotatably carried on shaft 67. Horizontal shaft 69 is also fixedly secured to vertical shafts 61, 62 so that handle 70 may be grasped and moved to the left or right to displace shafts 69, 61, 62 in the directions indicated by arrows C. End 71 of shaft 69 slides along curved aperture 72 formed in rectangular member 73 when handle 70 is moved through an arc to the left or right. Member 73 is preferably fixedly secured to member 63. Shaft 69 may be secured in position by tightening a nut (not visible) on the portion of the end 71 passing through and past member 73. The nut is tightened against member 73. During operation of the machine, chain 38 in FIG. 2 rotates sprocket 40 causing pulley wheels 66 to rotate in the direction indicated by arrow D in FIG. 6. Rod 75 is rotatably received by bushings in members 63, 64. Sprockets 76, 77 (See FIG. 5) are fixedly carried on rod shaft 75 and respectively engage toothed tracks 78, 79. When handle 80 on shaft 75 is turned, sprockets 76, 77 rotate to laterally displace vertically disposed endless belt unit 55 along tracks 78, 79. Vertically disposed endless belt unit 56 is substantially identical in construction and operation to belt unit 55 and includes endless belts 60A, pulley wheels 66A and 68A carried on shafts 45A and 67A, wheel handles 70A and 80A, sprockets 76A and 77A, shaft 75A, members 64A and 63A, member 73A rixedly secured to member 63A and having slot 72A, and sprocket 49A fixedly attached to rotary shaft 45A. As shown in FIGS. 2 and 3, during operation of the machine chain 38 causes sprocket 40A to rotate in a counterclockwise direction. As sprocket 49A rotates, shaft 45A and wheel pulleys 66A fixedly secured to shaft 45A also rotate causing belts 60A to move in the direction indicated by the parallel arrows X adjacent belt 60A in FIG. 3.

The spaced, outwardly projecting, upstanding, horizontally disposed elongate feet 81, 81A on endless belts 60, 60A in FIG. 3 provide support for the creased edges of folded paper and help prevent the paper from downwardly sliding between vertically dispsed endless belt units 55, 56. As would be appreciated by those of skill in the art, a series of horizontally disposed raised dots 82 or a horizontal row of vertically oriented upstanding feet 83 (FIG. 9) could, along with a variety of other upstanding, outwardly projecting elements, be formed on the outer peripheral surfaces of belts 60, 60A to provide support for the creased edges of paper and to impede folded paper from sliding downwardly between vertically disposed endless belts 60, 60A. As shown in FIG. 3, belts 60 in vertically disposed unit 55 are generally parallelably opposed to belts 60A in unit 56. The horizontal distance or span between belts 60 and 60A is approximately equivalent to the lengths into which paper 28 is being folded. However, as depicted in FIG. 8, units 55, 56 may be rotated toward one another so the distance between belts 60, 60A is less near the bottom of units 55, 56 than at the top portion of units 55, 56. Positioning of the belt units as shown in FIG. 8 tends to assist raised edges 81A, 81 in preventing folded paper from sliding downwardly between units 55, 56. Brushes 85 may also be positioned adjacent folded paper to retard the travel of the paper downwardly away from distributing rollers 49, 50. In FIG. 7, brushes 85 are slidably carried by members 86 fixedly secured to the frame of the machine. Each brush can be slid in the directions indicated by arrow E. Set screws 88 secure each brush in the desired fixed position with respect to members 86 and to the stack of folded paper 89.

In operation, continuous paper strip 28 is fed between distribution rollers 49, 50 by roller 48. Distribution rollers alternately distribute transverse lines of weakening in paper 28 in substantially opposite directions. Continuous belts 60, 60A receive the lines of weakening distributed by rollers 49, 50 and assist in creasing and folding paper 28. Moving belts 60, 60A gradually carry the folded paper downwardly away from rollers 49, 50 and deliver the paper to the conveyor table 11. Belts 60, 60A move rather slowly so that (as shown in FIG. 3), the space between the creased edges of folded sheet 90 at the top of the stack and belts 51, 54 is minimal; consequently, when a new line of weakening is dispensed by rollers 49, 50, it tends to maintain contact with either belts 51 or 54 until the line of weakening reaches belt 60 or 60A. The relatively small gap between the creased edges of folded sheet 90 and belts 51, 54 helps control the movement of unusually light paper and enables belts 51 or 54 to maintain contact with and assist in moving the paper until the lines of weakening contact belts 60 or 60A.

As shown in FIG. 8, folded paper sheets near the top of stack 89 may tend to sag in the middle and permit the creased edges of folded paper in stack 89 to slide over feet 81, 81A and downwardly between units 55, 56. Brushes 85 can be utilized to retard the sagging or downward movement of folded paper, or as pictured in FIG. 8, the lower ends of units 55, 56 can be moved toward one another to form an upward bulge in the folded paper held between belts 60, 60A near the bottom of units 55, 56. This upward bulge tends to offset the sagging in folded paper held between belts 60, 60A near the tops of units 55, 56 adjacent belts 51, 54.

It is believed the apparatus of the invention is the first which can successfully fold at high rates of speed lightweight chart paper of the type utilized in electrocardiogram machines and in other scientific recording equipment.

As shown in FIGS. 3 and 5, in the presently preferred embodiment of the invention belts 51, 54 and rollers 49, 50, 52, 53 all generally lie in an imaginary horizontal plane while belts 60, spools 66 and 68, and elongate rods 61 and 62 of unit 55 generally lie in an imaginary vertically oriented plane. Belts 60A, rod 62A and spools 68A of unit 56 also lie in an imaginary vertically oriented plane. The arrangement of the distribution rollers 49, 50 and of units 55, 56 in the presently preferred embodiment of the invention causes paper to be downwardly dispensed from rollers 49, 50 and then carried downwardly between opposed belt units 55, 56.

The apparatus of the invention can be oriented such that distribution rollers 49, 50 and units 55, 56 dispense and carry folded paper in any upward, downward or lateral direction of travel. For instance, rollers 49, 50, 52, 53 and belts 51, 54 could be oriented so they generally lay within an imaginary vertical plane and units 55, 56 accordingly oriented so the belts, spools and elongate rods of each unit generally lay within an imaginary horizontal plane. For example, spools 68, belts 60 and elongate rods 61, 62 of unit 55 would lay within a generally horizontal imaginary plane. When rollers 49, 50 were positioned in an imaginary vertical plane and units 55, 56 each positioned in its own imaginary horizontal plane as just described, paper dispensed by rollers 49, 50 would be received by and carried between units 55, 56 in a direction of travel generally parallel to a horizontal imaginary plane. This horizontal direction of travel would be oriented approximately 90° from the downward direction of travel of the folded paper in the presently preferred embodiment of the apparatus shown in FIG. 3.

Or, rollers 49, 50 and belts 51, 54 could be oriented in an imaginary horizontal plane as shown in FIG. 3, but operated so paper was dispensed upwardly from rollers 49, 50 instead of being dispensed downwardly as is paper 90 in FIG. 3. If rollers 49, 50 and belts 51, 54 dispensed paper upwardly, then units 55, 56 would be positioned above rollers 49, 50 to receive therebetween paper dispensed by rollers 49, 50 and to carry the paper upwardly in a direction of travel generally opposite the downward direction of travel of folded paper 90 in FIG. 3.

Thus, distribution rollers 49, 50 and belts 51, 54 can be oriented such that paper is dispensed therefrom in any desired upward, downward or lateral direction and belt units 55, 56 correspondingly positioned as necessary to receive therebetween paper dispensed from rollers 49, 50 and carry the paper away from rollers 49, 50.

The rollers, belts and spools of each belt unit 55, 56 lie in an imaginary plane which is generally perpendicular or at an angle to the imaginary plane generally containing rollers 49, 50, 52, 53 and belts 51, 54. Thus, in FIG. 3, roller 68, belts 60 and rod 62 generally lie in a vertical imaginary plane which is generally perpendicular to the horizontal imaginary plane which generally contains rollers 49, 50, 52, 53 and belts 51, 54.

Having described my invention in such terms as to enable those skilled in the art to which it pertains to understand and practice it, and having described the presently preferred embodiments thereof, I claim:

1. In combination with apparatus for producing continuous form stationery by folding a strip of paper along transverse lines of weakening formed therein, said apparatus including:

a frame;

primary endless belt means mounted on said frame for alternately distributing said transverse lines of weakening in said paper in substantially opposite lateral directions of travel to form creased edges in said paper along said lines of weakening, said belt means including a pair of spaced adjacent parallelably disposed paper distribution rollers, each of said rollers having a generally constant diameter along the length thereof, and a longitudinal axis about which said rollers rotate; and belts trained around said distribution rollers to form laterally extending conveyor runs with the belts and rollers cooperatively forming a passage between the distributing rollers to allow the paper strip to be fed through the passage; said belts having two runs which move in opposite directions to propel said strip in said opposite lateral directions;

means carried on said frame for directing said continuous strip of paper to said passage and into contact with at least some of said belts for said lateral distribution in said substantially opposite directions, said lateral distribution directions being generally perpendicular to said longitudinal axes of said distribution rollers, delivery means for receiving paper distribution by said primary endless belt means, said delivery means including (a) first endless belt means including at least one moving endless belt having an outer peripheral surface including outwardly projecting feet connected to and spaced therealong; and (b) second endless belt means spaced apart from and in generally opposed, parallel relation to said first endless belt means by a distance approximately equal to the length of paper strip between two transverse lines of weakening, said second endless belt means including at least one moving endless belt having an outer peripheral surface including outwardly projecting feet connected to and spaced therealong, said first and second endless belt means being positioned on said frame to respectively extend away from a position adjacent said two runs of said belts and being operatively associated with said primary endless belt means (c) to receive therebetween paper distributed by said primary belt means and carry said distributed paper away from said primary belt means;

(d) to cooperate with said primary belt means to fold said distributed paper along selected ones of said lines of weakening to produce a zig-zag stack of paper having a plurality of creased edges between said first and second endless belt means, said stack having a top portion and a bottom portion, each of said creased edges of paper generally contacting said outer peripheral surface of at least one of said endless belts carried by said first and second endless belt means, (e) such that paper distributed by said primary belt means generally initially moves (i) between and contacts said top portion of said stack of paper and at least one of said belts of said primary belt means, and (ii) in a general direction of travel toward one of said endless belt means of said delivery means, while being distributed on said top portion of said zig-zag stack of paper to form said creased edges contacting said endless belts of said endless belt means of said delivery means, said movement of said distributed paper between said top portion of said stack of zig-zag paper and said belts of said primary belt means controlling said movement of said paper and facilitating the folding of lightweight paper by said apparatus, said feet being shaped, contoured and dimensioned to maintain each of said creased edges of said zig-zag stack of paper contacting said outer peripheral surface of one of said endless belts in a generally fixed position with respect to said outer peripheral surface of said endless belt.

2. The apparatus of claim 1 wherein said belts trained around said distribution rollers are spaced apart therealong and a portion of each of said endless belts of said first and second endless belt means is positioned in one of said spaces between said belts of said primary belt means.

* * * * *